US006413919B2

(12) United States Patent
Vidarsson

(10) Patent No.: US 6,413,919 B2
(45) Date of Patent: Jul. 2, 2002

(54) LUBRICANT COMBINATION AND PROCESS FOR THE PREPARATION THEREOF

(75) Inventor: Hilmar Vidarsson, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/769,321

(22) Filed: Jan. 26, 2001

Related U.S. Application Data

(63) Continuation of application No. PCT/SE00/02397, filed on Dec. 1, 2000.

(30) Foreign Application Priority Data

Dec. 2, 1999 (SE) ..... 9904367

(51) Int. Cl.[7] ..... C10M 105/68
(52) U.S. Cl. ..... 508/528; 75/252
(58) Field of Search ..... 508/528; 75/252

(56) References Cited

U.S. PATENT DOCUMENTS 5,039,435 A * 8/1991 Hanano ..... 106/38.22
5,154,839 A * 10/1992 Hanano ..... 106/38.22
5,256,185 A * 10/1993 Semel et al. ..... 75/255
5,308,702 A * 5/1994 Furukimi et al. ..... 428/403
5,468,401 A * 11/1995 Lum et al. ..... 72/42
5,476,534 A * 12/1995 Ogura et al. ..... 75/252
5,484,469 A * 1/1996 Rutz et al. ..... 75/252
5,989,304 A * 11/1999 Ozaki et al. ..... 75/252
6,231,635 B1 * 5/2001 Suzuki et al. ..... 508/528

FOREIGN PATENT DOCUMENTS

JP 54117873 3/1978
WO 05453 2/1998

* cited by examiner

*Primary Examiner*—Jacqueline V. Howard
(74) *Attorney, Agent, or Firm*—Burns, Doane, Swecker & Mathis L.L.P.

(57) ABSTRACT

The invention concerns a process for the preparation of a lubricant combination including to steps of selecting a first and a second lubricant; mixing the lubricants and subjecting the mixture to conditions for adhering the particles of the second lubricant to the particles of the first lubricant in order to form a lubricant combination of aggregate particles having a core of the first lubricant, the surface of the core being coated with particles of the second lubricant. The invention also concerns a surface modified lubricant combination including a core of a first lubricant, the surface of which is coated with particles of a second lubricant.

19 Claims, No Drawings

LUBRICANT COMBINATION AND PROCESS FOR THE PREPARATION THEREOF

This is a continuation of International application No. PCT/SE00/02397, filed Dec. 1, 2000 that designates the United States of America and was published under PCT Article 21(2) in English and claims priority for Application No. 99043671, filed in Sweden on Dec. 2, 1999.

This invention relates to a lubricant combination for powder metallurgy and to the manufacture and use of this lubricant combination. More particularly the invention concerns a lubricant combination including at least two lubricants.

Powdered metals, for example, powdered iron, are used to make small, fairly intricate parts, for example, gears. The fabrication of such metallic parts by powdered metal technology involves the following steps:

- the powdered metal is blended with a lubricant and other additives to form a mixture,
- the obtained mixture is poured into a mould and compacted to form a part using a high pressure, usually of the order of 200 to 1000 MPa,
- the part is ejected from the mould,
- the part is subjected to a high temperature to decompose and remove the lubricant and to cause all the particles of metal in the part to sinter together
- and the part is cooled, after which it is ready for use.

Lubricants are added to metal powders for several reasons. One reason is that they facilitate the production of compacts for sintering by lubricating the interior of the powder during the compaction process. Through selection of proper lubricants higher densities, which is often required, can be obtained. Furthermore, the lubricants provide the necessary lubricating action that is needed to eject the compacted part out of the die. Insufficient lubrication will result in wear and scuffing at the die surface through the excessive friction during the ejection, resulting in premature die failure. The problems with insufficient lubrication can be solved in two ways; either by increasing the amount of the lubricant or by selecting more efficient lubricants. By increasing the amount of lubricant, an undesired side effect is however encountered in that the gain in density through better "internal lubrication" is reversed by the increasing volume of the lubricant. The better choice would then be to select more efficient lubricants. This has however been found to be a difficult task as efficient lubricants tend to have negative effects on the powder properties of the mixture.

Another possibility would be to look for new ways to combine or use presently used lubricants in order to make them more efficient. The present invention concerns such a new combination of presently used lubricants. The concept of the invention is of course not limited to presently used and known lubricant but is applicable also to future lubricants.

According to the invention the method of making the new lubricants more efficient involves the steps of

- selecting a first and a second lubricant powder
- mixing the lubricant powders and
- subjecting the mixture to conditions for adhering the particles of the second lubricant to the particles of the first lubricant in order to form a lubricant combination of aggregate particles having a core of the first lubricant, the surface of the core being coated with particles of the second lubricant.

The main objective of the first lubricant is to impart good lubricating properties to the powder, which will give higher densities and low ejection forces, whereas the main objective of the second lubricant is to provide a metal powder mixture having good powder properties, such as high flow rates and uniform filling of the die, which in turn gives high productivity and even density distribution in a compacted part.

Examples of lubricants within the first group are fatty acid bis-amides, such as ethylene-bis-palmitinamide, ethylene-bis-stearamide, ethylene-bis-arachinamide, ethylene-bis-behenamide, hexylene-bis-palmitinamide, hexylene-bis-stearamide, hexylene-bis-arachinamide, hexylene-bis-behenamide, ethylene-bis-12-hydroxystearamide, distearyladipamide etc. and fatty acid monoamides, such as palmitinamide, stearamide, arachinamide, behenamide, oleiamide. Additionally the first lubricant may include a solid mixture of two or more lubricants.

The second lubricant may be selected from the group consisting of metal soaps, such as zinc stearate, lithium stearate.

It is preferred that the particles of the lubricant(s) are as close to spherical shape as possible as the spherical shape leads to the highest flow rate and apparent density.

It is furthermore preferred that the first lubricant has an average particle size which is larger than that of the second lubricant. More particularly it is preferred that the average particle size of the first lubricant is 2–3 times larger than that of the second lubricant and most particularly the average particle size of the first lubricant is at least 15 $\mu$m and the second lubricant has an average particle size of at most 6 $\mu$m. Additionally it has been found that the amount of the first lubricant preferably should be between 60 and 90% by weight of the total lubricant combination.

One way of providing conditions for adhering the lubricant particles involves heating the particles of the first and/or the second lubricant at a temperature and for a period of time sufficient for achieving a physical bonding between the particles of the first and the second lubricant.

When mixed with metal powders, the concentration of the lubricant combination plus optional conventional solid lubricants, is suitably in the range of 0.1 to 5% by weight, preferably from 0.3 to 1% by weight.

Metal powders of interest is preferably an iron based powder. Examples of iron based powders are alloyed iron based powder, such as a prealloyed iron powder or an iron powder having the alloying elements diffusion-bonded to the iron particles. The iron based powder may also be a mixture of an essentially pure iron powder and the alloying elements, which are eg selected from the group consisting of Ni, Cu, cr, Mo, Mn, P, Si, V and W. The various amounts of the different alloying elements are between 0 and 10, preferably between 1 and 6% by weight of Ni, between 0 and 8, preferably between 1 and 5% by weight of Cu, between 0 and 25, preferably between 0 and 12% by weight of Cr, between 0 and 5, preferably between 0 and 3 by weight of Mo, between 0 and 1, preferably between 0 and 0.6% by weight of P, between 0 and 5, preferably between 0 and 2% by weight of Si, between 0 and 3, preferably between 0 and 1% by weight of V and between 0 and 10, preferably between 0 and 4% by weight of W.

The iron based powder may be an atomised powder or a sponge iron powder.

The particle size of the iron based powder is selected depending on the final use of the sintered product.

The lubricant combination according to the invention is thus a surface modified lubricant having a core of one first lubricant wherein the core surface is coated of particles of second lubricant. A comparison between this lubricant combination and a physical mixture of the same lubricants shows that the properties of the lubricant combination are superior. The same is true also for a molten and subsequently solidified mixture of the same lubricants. The following non limiting example illustrates the invention.

EXAMPLE

Iron powder compositions were prepared by using lubricant compositions prepared by different methods. The lubricants were composed of the common recipe of 80% ethylene-bis-stearamide (EBS available as Hoechst Wachs from Clariant AG, Germany) having a melting point of about 145° C., and 20% zinc stearate (available from Megret, UK) having a melting point of about 130° C. The total lubricant content was 0.8% by weight in all cases. The iron powder was ASC 100.29 (available from Höganäs AB, Sweden) and 0.5% by weight of graphite was mixed with the iron powder and lubricant.

The first lubricant composition was prepared by micronizing the two ingredients separately down to average particle sizes below 30 μm and subsequently admixing to the iron powder mixture.

The second lubricant composition was prepared by first melting together and solidifying the lubricants, followed by micronization and admixing to the iron powder mixture as described above.

The third lubricant was prepared by adhering the zinc stearate particles to the surface of the EBS through heating of EBS particles to temperatures where partial melting of added zinc stearate particles occurs. A stable mechanical bond between the particles was thus achieved, with the larger EBS particles essentially covered by smaller zinc stearate particles. Also in this case the particle size was below about 30 μm.

After mixing, the powder properties of the iron powder compositions were characterised, including the Hall Flow, Apparent density and the Filling index. The Filling index is a measure of the relative difference in filling density (FD) between two cavities of different geometry; While the length and the depth of the cavities are the same (30 mm and 30 mm respectively), one cavity has a width of 13 mm and the other a width of 2 mm. The wider cavity gives larger filling density, and the filling index is defined as:

$$\text{Filling Index } (\%)=(Fd\max-FD\min)/Fd\max$$

Theoretically, the Filling index is approximately the same as the relative difference in green density obtained when a powder is pressed in a cavity having cavities of the same geometry as described above, i.e. with sections of different slit widths, e.g. 13 and 2 mm.

TABLE 1

| | Hall Flow (s/50 g) | Apparent Density (g/cm$^3$) | Filling Index (%) |
|---|---|---|---|
| Lubricant according to the present invention | 26.6 | 3.18 | 6.67 |
| Physical mixture of EBS/Zinc Stearate | No flow | 3.09 | 7.65 |
| Molten, solidified and micronized mixture of EBS/Zinc Stearate | 30.5 | 3.07 | 8.34 |

From the results presented in Table 1, it is evident that the modification of the EBS lubricant with zinc stearate according to the present invention gives valuable advantages in powder properties compared with conventional methods of physical mixing of the separate components into a powder mixture, or by adding a melted together and micronized lubricant composition. The flow rate is increased and the apparent density is raised. Furthermore, a more even filling is experienced, which is expected to give a more even density distribution in a complex pressed part compared with mixture made with conventional lubricants containing EBS or some other cohesive lubricants as a main constituent.

What is claimed is:

1. A process for the preparation of a lubricant combination including to steps of:

selecting a first lubricant powder selected from the group consisting of fatty acid bis-amides and fatty acid monoamides and a second lubricant powder selected from the group consisting of metal soaps, mixing the lubricant powders, and subjecting the mixture to conditions for adhering the particles of the second lubricant to the particles of the first lubricant in order to form a lubricant combination of aggregate particles having a core of the first lubricant with the surface of the core being coated with particles of the second lubricant.

2. Process according to claim 1 characterised in that the conditions for adhering the lubricant particles to each other involves heating the particles of the first and/or the second lubricant at a temperature and a period of time sufficient for achieving a physical bonding between the particles of the first and the second lubricant.

3. Process according to claim 1 characterised in that the particles of the first and second lubricants are essentially spherical.

4. Process according to claim 1 wherein the first lubricant has an average particle size of at least 15 μm and the second lubricant has an average particle size of at most 6 μm.

5. Process according to claim 1 wherein the first lubricant constitutes about 60 to 90% by weight of the lubricant combination.

6. Process according to claim 1 characterised in that the first lubricant includes a solid mixture of two or more lubricants.

7. Process according to claim 1 characterised in that the first lubricating agent is ethylene-bis-palmitinamide, ethylene-bis-stearamide, ethylene-bis-arachinamide, ethylene-bis-behenamide, hexylene-bis-palmitinamide, hexylene-bis-stearamide, hexylene-bis-arachinamide, hexylene-bis-behenamide, ethylene-bis-12-hydroxystearamide, distearyladipamide, palmitinamide, stearamide, arachinamide, behenamide, oleiamide or a combination thereof.

8. Process according to claim 1 characterised in that the second lubricating agent is zinc stearate or lithium stearate.

9. Process according to claim 2 characterised in that the particles of the first and second lubricants are essentially spherical.

10. Process according to claim 2 wherein the first lubricant has an average particle size of at least 15 μm and the second lubricant has an average particle size of at most 6 μm.

11. Process according to claim 3 wherein the first lubricant has an average particle size of at least 15 μm and the second lubricant has an average particle size of at most 6 μm.

12. Process according to claim 9 wherein the first lubricant has an average particle size of at least 15 μm and the second lubricant has an average particle size of at most 6 μm.

13. Process according to claim 2 characterised in that the first lubricant includes a solid mixture of two or more lubricants.

14. Process according to claim 3 characterised in that the first lubricant includes a solid mixture of two or more lubricants.

15. Process according to claim 4 characterised in that the first lubricant includes a solid mixture of two or more lubricants.

16. Process according to claim 5 characterised in that the first lubricant includes a solid mixture of two or more lubricants.

17. Process according to claim 9 characterised in that the first lubricant includes a solid mixture of two or more lubricants.

18. Process according to claim 12 characterised in that the first lubricant includes a solid mixture of two or more lubricants.

19. A lubricant combination of aggregate lubricant particles wherein the combination has a core of a first lubricant selected from the group consisting of fatty acid bis-amides and fatty acid monoamides and second lubricant selected from the group consisting of metal soaps.

* * * * *